US009187931B2

(12) United States Patent
Hudson et al.

(10) Patent No.: US 9,187,931 B2
(45) Date of Patent: Nov. 17, 2015

(54) SLIDING PIN LOCK MECHANISM FOR OVERHEAD DOOR

(75) Inventors: Dale R. Hudson, Jamesville, NY (US); Jay Tillman, Southbury, CT (US)

(73) Assignee: Jamas Enterprises LLC, Syracuse, NY (US)

( * ) Notice: Subject to any disclaimer, the term of this patent is extended or adjusted under 35 U.S.C. 154(b) by 398 days.

(21) Appl. No.: 13/600,838

(22) Filed: Aug. 31, 2012

(65) Prior Publication Data

US 2013/0056995 A1 Mar. 7, 2013

Related U.S. Application Data

(60) Provisional application No. 61/530,098, filed on Sep. 1, 2011.

(51) Int. Cl.

| | |
|---|---|
| ***E05C 1/02*** | (2006.01) |
| ***E05B 65/08*** | (2006.01) |
| ***E05B 65/00*** | (2006.01) |
| *E05C 1/06* | (2006.01) |
| *E05C 1/04* | (2006.01) |
| *E05D 15/00* | (2006.01) |

(52) U.S. Cl.

CPC ..... *E05B 65/0882* (2013.01); *E05B 65/0021* (2013.01); *Y10T 292/1003* (2015.04)

(58) Field of Classification Search

USPC ..... 292/137, 216, 341.14, 163, 164, 174, 292/175, 173, 138, 143, 146, DIG. 36, 292/DIG. 15, 229, 231, 237–239, 181, 177; 160/201

See application file for complete search history.

(56) References Cited

U.S. PATENT DOCUMENTS

| | | | | | |
|---|---|---|---|---|---|
| 634,213 | A | * | 10/1899 | Heidt | 292/27 |
| 1,099,626 | A | * | 6/1914 | Stevenson | 292/227 |
| 1,198,862 | A | * | 9/1916 | McCormack | 292/332 |
| 1,367,822 | A | * | 2/1921 | Lindsay | 292/175 |
| 1,368,041 | A | * | 2/1921 | Malone | 292/164 |
| 1,486,240 | A | * | 3/1924 | Geiser | 15/265 |
| 1,570,135 | A | * | 1/1926 | Emmert | 292/334 |
| 1,630,002 | A | * | 5/1927 | Gray | 292/164 |
| 1,724,116 | A | * | 8/1929 | Swearengin | 292/175 |
| 2,185,828 | A | * | 1/1940 | Blodgett | 49/322 |
| 2,198,079 | A | * | 4/1940 | Ferris et al. | 292/143 |
| 2,204,116 | A | * | 6/1940 | Blocher | 411/347 |
| 2,393,287 | A | * | 1/1946 | Buehner | 160/201 |
| 2,593,247 | A | * | 4/1952 | Benteman | 280/515 |
| 2,612,396 | A | * | 9/1952 | Venditty | 292/47 |
| 2,651,817 | A | * | 9/1953 | Moler | 160/189 |
| 2,665,932 | A | * | 1/1954 | Moler | 292/177 |
| 2,689,777 | A | * | 9/1954 | Wolters | 312/332.1 |
| 2,781,215 | A | * | 2/1957 | Griffith | 292/148 |
| 3,188,698 | A | * | 6/1965 | Zoll et al. | 49/322 |
| 3,247,753 | A | * | 4/1966 | Appleberry | 411/350 |

(Continued)

*Primary Examiner* — Kristina Fulton
*Assistant Examiner* — Faria Ahmad
(74) *Attorney, Agent, or Firm* — Bernhard P. Molldrem, Jr.

(57) ABSTRACT

A door lock mechanism for an overhead door employs a sliding pin or rod that passes into the path of the rollers in the track, and obstructs the roller from movement in the direction to open the door. A spring in the door lock frame biases the sliding pin towards a proximal open position. The sliding pin has an arm that extends radially from its proximal end, and which engages retaining structure at the proximal end of the door lock frame. The arm is rotated out of engagement with the retaining structure to release the pin so it may slide proximally to an unlocked position. The pin may slide into a receiver housing mounted on a door panel.

9 Claims, 7 Drawing Sheets

(56) References Cited

U.S. PATENT DOCUMENTS

| | | | | | |
|---|---|---|---|---|---|
| 3,300,265 | A * | 1/1967 | Wilmer et al. | 312/303 |
| 3,933,382 | A * | 1/1976 | Counts et al. | 292/144 |
| 3,961,816 | A * | 6/1976 | Mueller | 292/148 |
| 4,080,757 | A * | 3/1978 | Westerman | 49/322 |
| 4,385,471 | A * | 5/1983 | Gabry et al. | 49/322 |
| 4,505,501 | A * | 3/1985 | Fuchs et al. | 292/62 |
| 4,579,364 | A * | 4/1986 | Kranz | 280/507 |
| 4,613,175 | A * | 9/1986 | Nelson | 292/148 |
| 4,776,134 | A * | 10/1988 | Romberg | 49/394 |
| 4,861,079 | A * | 8/1989 | DeForrest, Sr. | 292/148 |
| 4,997,218 | A * | 3/1991 | Culling | 292/60 |
| 5,104,163 | A * | 4/1992 | Palmer et al. | 292/335 |
| 5,168,914 | A * | 12/1992 | Keller | 160/207 |
| 5,291,686 | A * | 3/1994 | Sears et al. | 49/322 |
| 5,533,561 | A * | 7/1996 | Forehand, IV | 160/188 |
| 5,535,805 | A * | 7/1996 | Kellogg et al. | 160/201 |
| 5,609,371 | A * | 3/1997 | Mader et al. | 292/164 |
| 5,685,578 | A * | 11/1997 | Schneider | 292/144 |
| 5,685,594 | A * | 11/1997 | Harper | 296/51 |
| 5,704,166 | A * | 1/1998 | Tam et al. | 49/322 |
| 5,794,990 | A * | 8/1998 | Coppedge | 292/153 |
| 6,027,148 | A | 2/2000 | Shoemaker | |
| 6,042,158 | A * | 3/2000 | Horn | 292/165 |
| 6,079,237 | A * | 6/2000 | Hochart | 70/278.6 |
| 6,082,046 | A * | 7/2000 | Simmons | 49/26 |
| 6,089,626 | A | 7/2000 | Shoemaker | |
| 6,102,452 | A * | 8/2000 | Liau | 292/175 |
| 6,119,307 | A * | 9/2000 | Weishar et al. | 16/87 R |
| 6,189,266 | B1 * | 2/2001 | Mihalcheon | 49/322 |
| 6,193,260 | B1 * | 2/2001 | Homan et al. | 280/515 |
| 6,427,749 | B1 * | 8/2002 | Swink et al. | 160/188 |
| 6,463,989 | B1 * | 10/2002 | Johnson | 160/201 |
| 6,471,258 | B1 * | 10/2002 | Bombuy Perich | 292/165 |
| 6,550,838 | B2 * | 4/2003 | Bobbitt et al. | 296/52 |
| 6,601,418 | B2 * | 8/2003 | Huang | 70/280 |
| 6,640,496 | B2 * | 11/2003 | Mullet | 49/199 |
| 6,659,158 | B2 * | 12/2003 | Laugenbach | 160/270 |
| 6,672,009 | B1 * | 1/2004 | Wong et al. | 49/183 |
| 6,832,666 | B2 * | 12/2004 | Stringer | 182/118 |
| 6,834,464 | B2 | 12/2004 | Shoemaker | |
| 7,011,347 | B2 * | 3/2006 | Finardi | 292/171 |
| 7,114,753 | B2 * | 10/2006 | Nodorft | 292/137 |
| 7,152,889 | B2 * | 12/2006 | Jeffries | 292/215 |
| 7,172,222 | B1 * | 2/2007 | Hotovy | 292/57 |
| 7,234,502 | B2 * | 6/2007 | O'Malley | 160/191 |
| 7,240,524 | B1 * | 7/2007 | White et al. | 70/257 |
| 7,325,845 | B2 * | 2/2008 | Bartos et al. | 292/332 |
| 7,331,616 | B2 * | 2/2008 | Brei et al. | 292/100 |
| 7,398,987 | B2 * | 7/2008 | Roe et al. | 280/515 |
| 7,484,332 | B2 * | 2/2009 | Hormann et al. | 49/322 |
| 7,549,456 | B2 * | 6/2009 | Preising, Jr. | 160/201 |
| 7,648,180 | B2 * | 1/2010 | Petry | 292/137 |
| 7,861,762 | B2 * | 1/2011 | Meichtry | 160/210 |
| 7,891,400 | B2 * | 2/2011 | Meichtry | 160/210 |
| 8,250,811 | B2 * | 8/2012 | Zijlstra | 49/394 |
| 8,505,608 | B2 * | 8/2013 | Sawada | 160/133 |
| 8,517,433 | B2 * | 8/2013 | Pritz et al. | 292/57 |
| 8,555,949 | B2 * | 10/2013 | Mortier | 160/201 |
| 8,596,330 | B2 * | 12/2013 | Slusarski et al. | 160/271 |
| 8,893,764 | B2 * | 11/2014 | Mascari et al. | 160/201 |
| 2004/0251694 | A1 * | 12/2004 | Gorski | 292/175 |
| 2005/0017516 | A1 * | 1/2005 | Finardi | 292/137 |
| 2007/0181268 | A1 * | 8/2007 | Chamberlain et al. | 160/201 |
| 2009/0044453 | A1 * | 2/2009 | Meichtry | 49/197 |
| 2009/0044917 | A1 * | 2/2009 | Meichtry | 160/201 |
| 2009/0145182 | A1 * | 6/2009 | Bettin et al. | 70/237 |
| 2010/0089106 | A1 * | 4/2010 | Bowers, II | 70/129 |
| 2010/0180511 | A1 * | 7/2010 | Mahdi | 49/501 |
| 2011/0252844 | A1 | 10/2011 | Shoemaker | |
| 2011/0291426 | A1 * | 12/2011 | Gibson | 292/137 |
| 2012/0305565 | A1 * | 12/2012 | Hansen et al. | 220/315 |
| 2014/0167425 | A1 * | 6/2014 | Dost et al. | 292/201 |
| 2014/0203569 | A1 * | 7/2014 | Stile | 292/137 |

* cited by examiner

SLIDING PIN LOCK MECHANISM FOR OVERHEAD DOOR

Priority is claimed under 35 U.S.C. 119(e) of Provisional Patent Appln. Ser. No. 61/530,098, filed Sep. 1, 2011.

BACKGROUND OF THE INVENTION

This invention relates to locking mechanisms for use with an overhead door, in particular with the type of overhead door on which supporting rollers move up or down in a vertical track or rail. The locking mechanism provides a bar or rod that passes into the path of the rollers in the track, and obstructs the roller from movement in the direction to open the door. The locking mechanism is a straightforward mechanical item with a frame, bar, spring, and a place to secure a padlock to hold the mechanism in its locked position.

To date, overhead door locks of this kind have been made of a sheet steel bent into a box shape which is mounted onto the door, with a bar that slides through slots in the box, and which enters a slot cut in the track or rail. These devices are prone to bending and deforming, and are often damaged after a period of normal use in an industrial or warehouse environment. Consequently, there is a need for frequent replacement. Also, the security afforded by these conventional overhead door locks is quite limited.

An example of a lock for an overhead door is described in Shoemaker U.S. Pat. No. 6,027,148 in which a fixed component mounted onto the frame of the overhead door, i.e., somewhere along the track, captures a rod that is mounted somewhere on the movable overhead door, entering an opening in a rotary element that turns and is retained in a detent. This is a fairly complex apparatus, with numerous moving parts which can be easily knocked out of alignment.

Another example of a lock for an overhead door is described in Shoemaker Patent Application Publication Pub. No. 2003/0188489, in which a rocking member, e.g., a cam, is disposed in a trackway of the overhead door, allowing the door to close but blocking a track wheel to prevent opening until the cam is moved out of the way. This device automatically moves the cam to the closed position, and a solenoid needs to be actuated to release the cam to permit the overhead door to open.

OBJECTS AND SUMMARY OF THE INVENTION

Accordingly, it is an object of the present invention to provide an overhead door lock mechanism that avoids the drawbacks of the prior art.

It is another object to provide an overhead door lock mechanism that is robust and reliable, and which will sustain, without damage, forces and shocks expected in normal use, and achieve an increase in use lifetime and in the level of security afforded.

It is a more specific object to provide an overhead door lock that mounts directly onto the vertical rails or tracks, rather than on the door.

In accordance with one aspect of the present invention, in the track-mounted overhead door lock mechanism, a round rod or dowel moves, i.e., slides distally through a hole in the web of the track or rail to block travel of the rollers up the track. The device has a frame in which there is a mounting block that is affixed onto the track using standard overhead door fastening hardware, a plate that extends proximally, i.e., out laterally away from the web of the overhead door rail, and a second block or plate spaced proximally from the mounting block. There are aligned circular openings in the second block and in the mounting block, and the sliding pin or dowel passes through these openings. The pin can also be rotated at least a limited amount between latched and unlatched positions. A coil spring is positioned over the spin or dowel between the mounting block and a retaining pin or retaining ring on the sliding pin, so as to urge the latter towards its open or unlock position. A corresponding opening is formed or drilled in the track to allow the pin to penetrate and block the travel of the rollers when in the locked position. Alternatively, the pin can slide into a receiver plate or receiver housing mounted on a door panel.

A swing arm extends radially from the proximal end of the pin, and this is rotatable into or out of alignment with a retaining plate or a retaining slot. The retaining plate or slot holds the arm and the sliding pin in place in the locked position; if the swing arm is rotated out of engagement, the spring urges the pin out to its unlocked or open position. Some means is provided for insertion of a padlock or other key or combination lock to prevent the swing arm from being rotated to the unlock position; this can be an opening in the retaining plate, in the radial arm of the pin, or in both.

In a preferred mode, the pin or dowel is formed of a hard, rigid steel, such as a tool steel of the type used in drills. There are mounting holes formed in the distal or mounting block for accepting mounting screws or bolts to attach the locking device to the track or rail.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
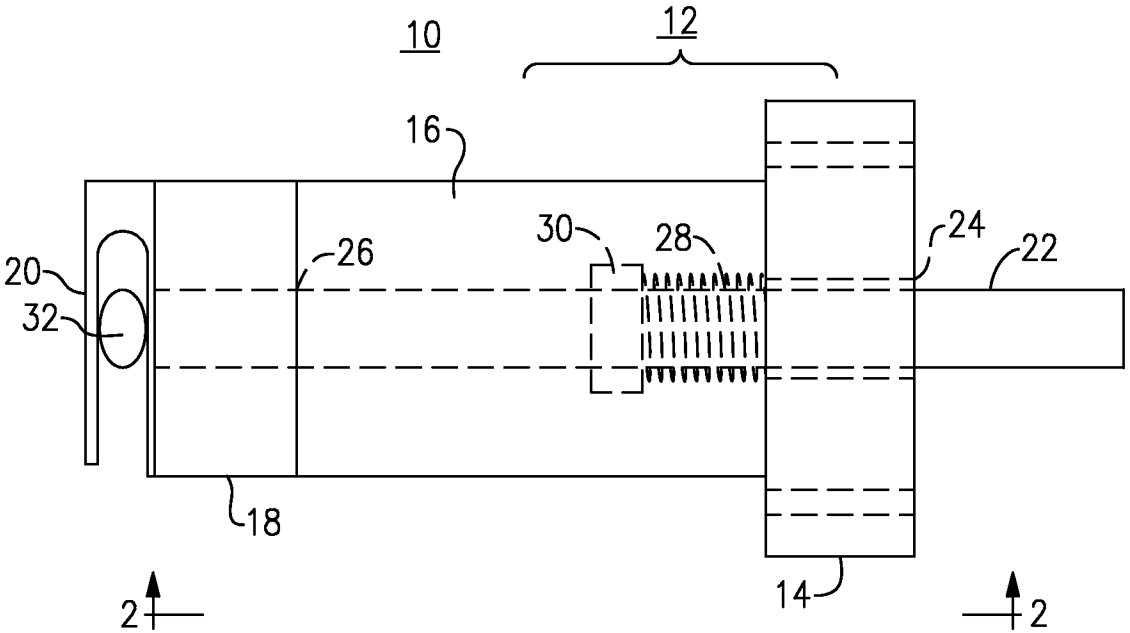
FIG. 1 is a schematic elevation of an overhead door lock according to one embodiment of this invention.
Figure 2:
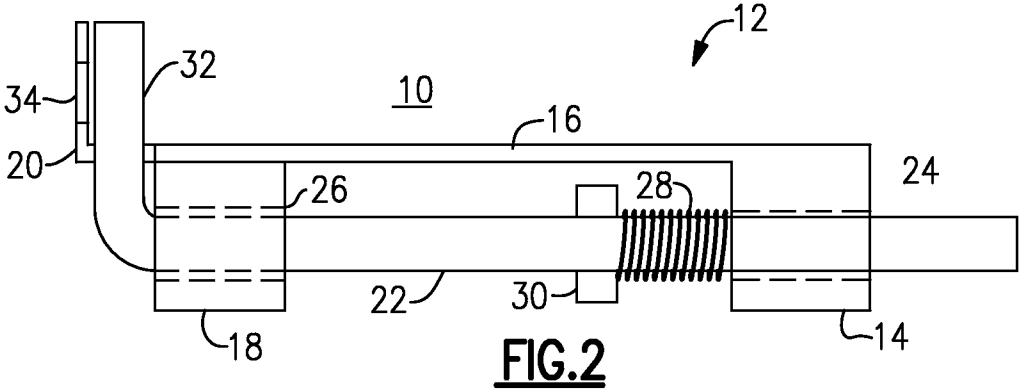
FIGS. 2 and 3 are lower plan views of the lock mechanism of this embodiment, showing the sliding pin in the closed or locked and in the open or unlocked positions, respectively.
Figure 3:
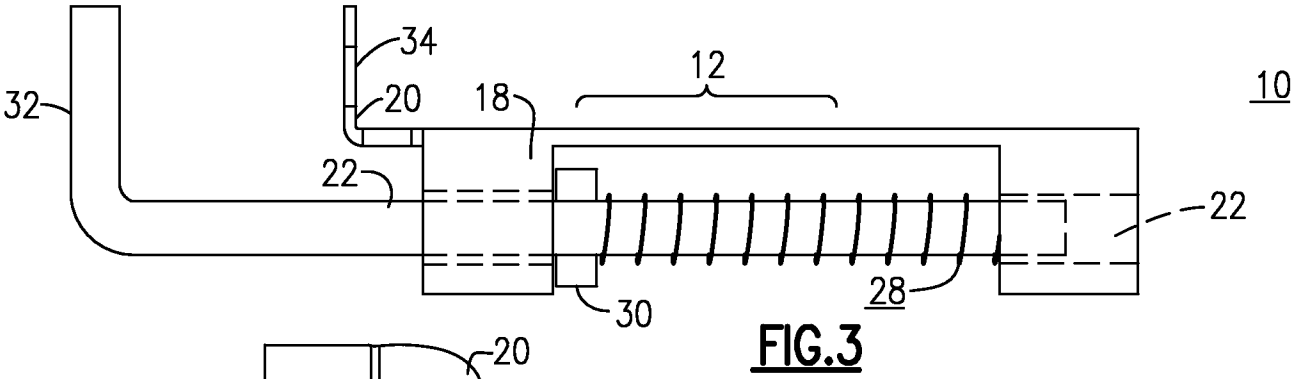
Figure 4:
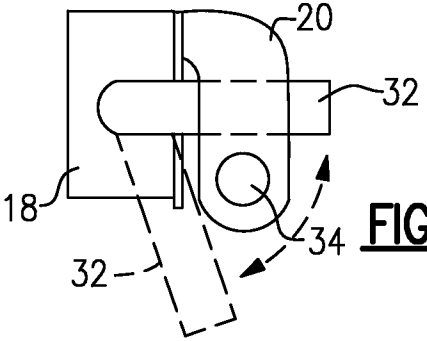
FIG. 4 is an end view thereof.
Figure 5:
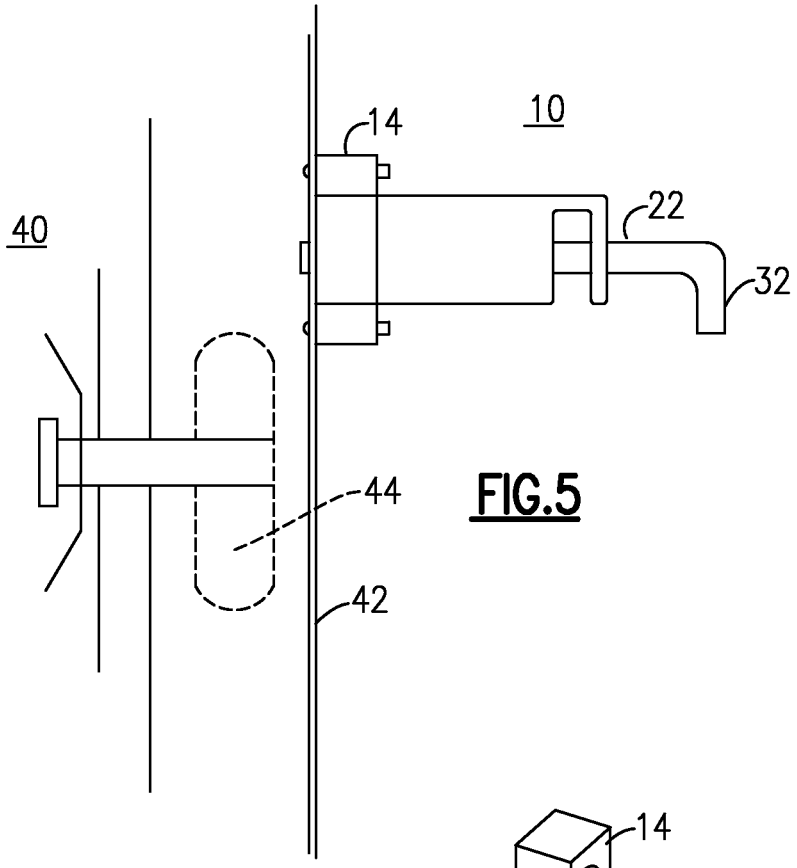
FIG. 5 is an elevation view of this embodiment mounted on an overhead door rail or track.

With reference now to the Drawing, and initially to FIG. 1, a sliding-pin lock mechanism 10 according to a first embodiment has a frame 12 that comprises a generally vertical mounting block 14, here shown with upper and lower openings (un-numbered) to accommodate mounting bolts or screws, a transverse steel plate 16 which extends to proximal, i.e., laterally away from the mounting block 14 and associated rail, and a second or proximal block 18. A portion of the plate 16 extends proximally past the block 18 and is bent to form a retaining plate member 20, with a gap to accommodate the swing arm of the pin, as will be discussed shortly. As seen also in FIGS. 2 to 5, a round profile rod, dowel or pin 22 extends laterally through the frame 12 and there are aligned round passages 24 and 26 in the mounting block 14 and second block 18, respectively for the pin 22. As shown in FIGS. 2 and 3, a coil spring 28 is positioned over the pin 22 between the mounting block 14 and a retaining device, here a retaining ring 30 affixed onto the pin between the blocks 14 and 18. The ring 30 limits travel of the pin 22 to proximal, as shown in FIG. 3.

At the proximal end of the pin 22 there is a radial arm 32, i.e., situated at ninety degrees to the axis of the pin 22, and which can engage in the slot or gap between the second block 18 and the retaining plate 20 to hold the pin 22 in the locked position, as shown in FIG. 2. This arm 32 on the pin 22 can be rotated by hand out of engagement with the retaining plate 20 (see broken line in FIG. 4), which then allows the spring 28 to push the pin 22 out, proximally, to the unlocked position, as shown in FIG. 3. There is an opening 34 provided in the retaining plate 20, or in the arm 32, or both, to accommodate a padlock or similar device to secure the mechanism in the closed or locked position.

FIGS. 5 to 8 show the arrangement of the locking device 10 of this embodiment in connection with a vertically-openable overhead door 40, with steel tracks or rails 42 that accommodate the wheels or rollers 44 of the door. The locking device 10 can be readily mounted directly onto the outer web 43 of the vertical track 42, by drilling suitable openings in the web 43 of the track to accommodate bolts or other mounting hardware and an opening for the passage of the locking pin 22. The position for mounting is selected so that the wheel or roller 44 will be biased upwardly against the pin 22 by action of the door seal bead when the door 40 is closed and the lock 10 is engaged or locked.

Figure 8:
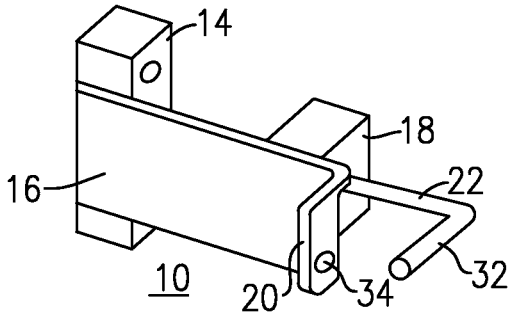
FIG. 8 is a perspective view of this embodiment.
Figure 6:
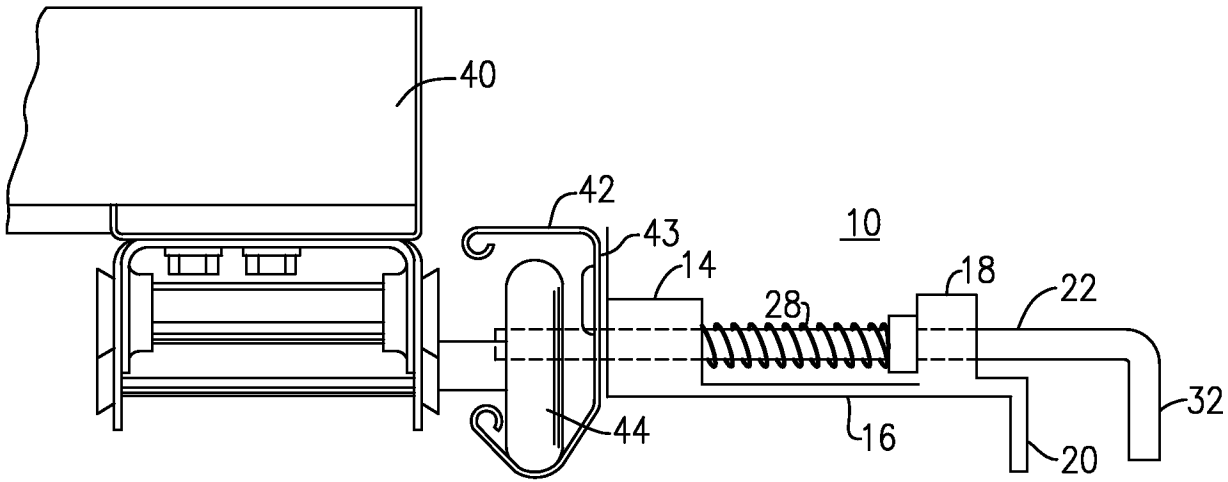
FIG. 6 is a top plan view thereof.
Figure 7:
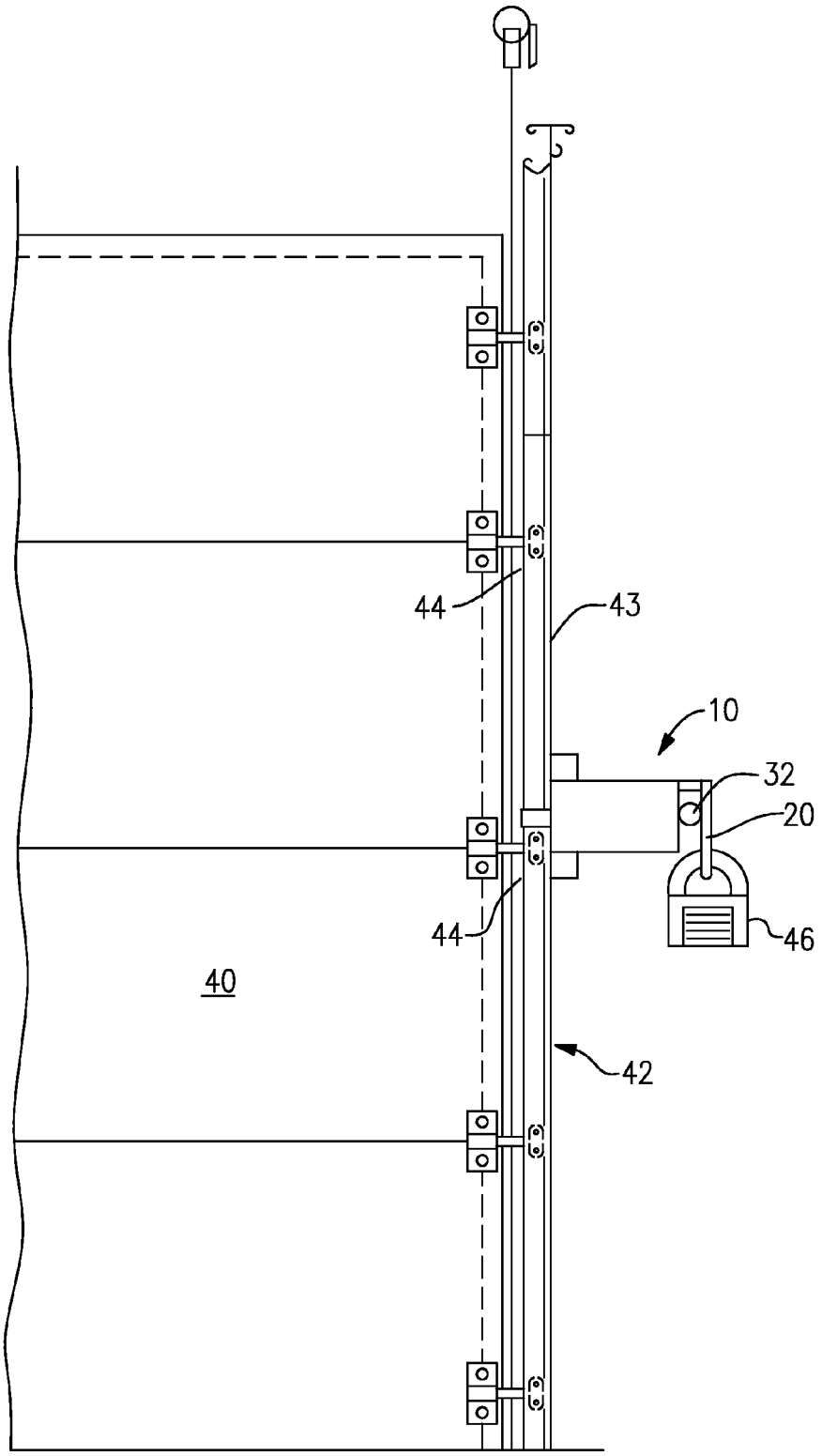
FIG. 7 is an environmental view of the overhead door, vertical track or rail, and lock mechanism of this embodiment.
Figure 9:
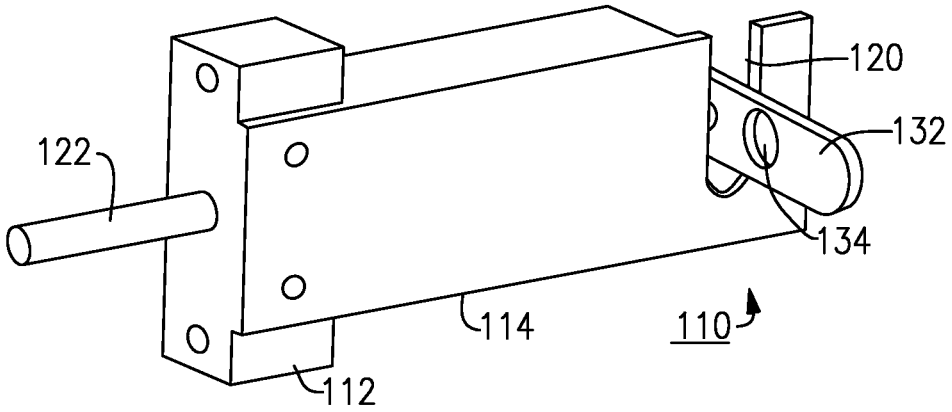
FIGS. 9 and 10 are perspective views of the front and rear, respectively, of an overhead door lock mechanism according to another embodiment, here showing the mechanism in its locked position.
Figure 10:
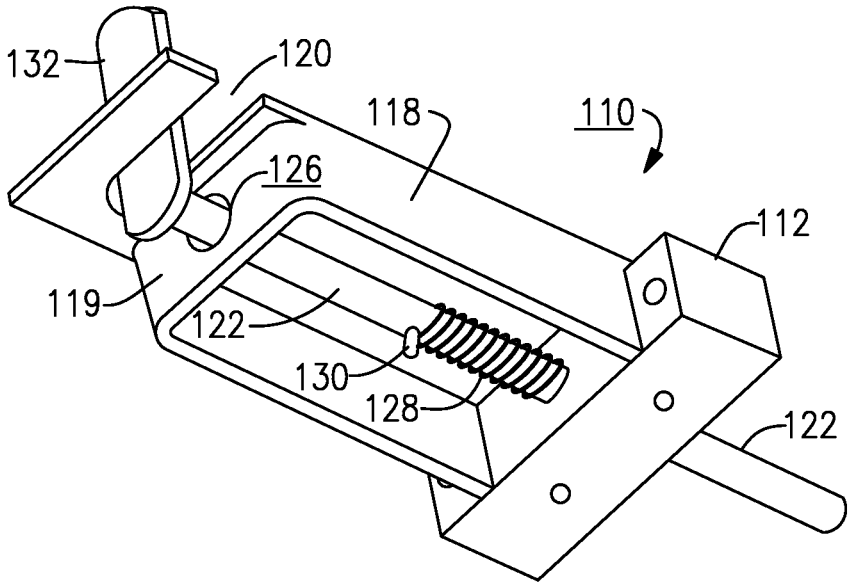
Figure 11:
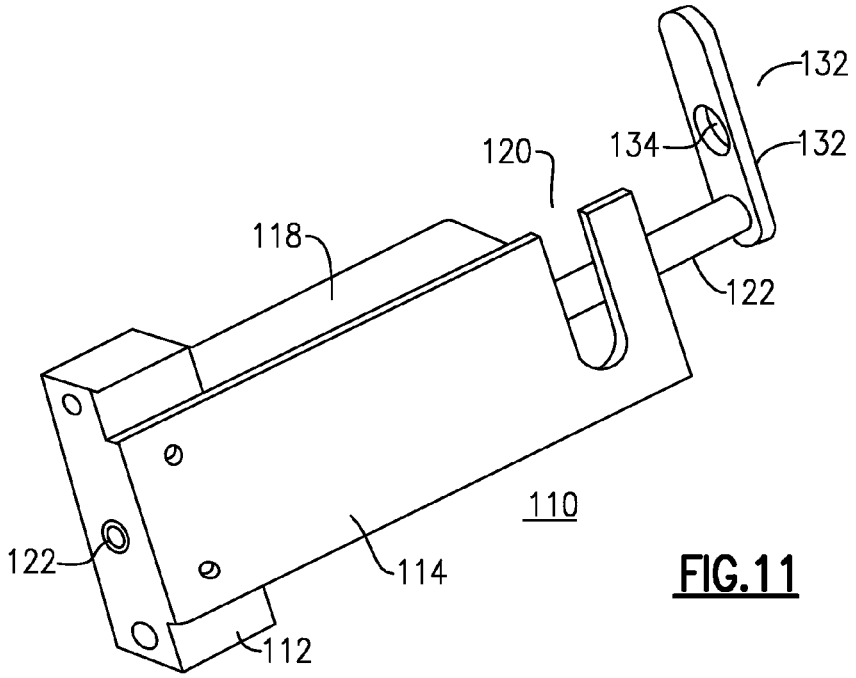
FIGS. 11 and 12 are perspective views of the front and rear thereof here showing the mechanism in its open or unlocked position.
Figure 12:
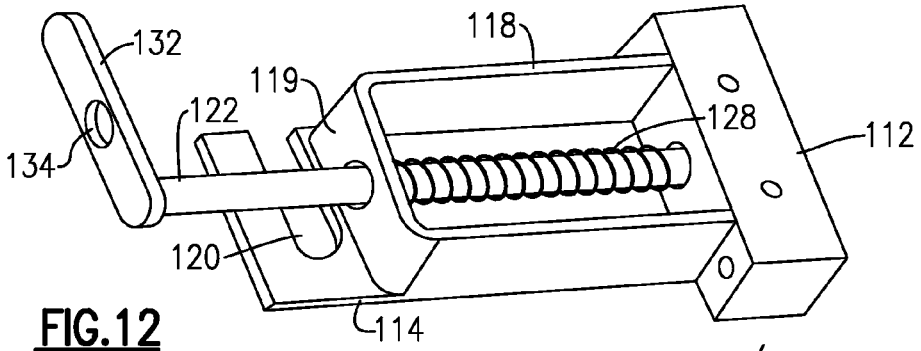

FIG. 7 shows the locking device 10 on the door rail 42, here secured in the locked position with a padlock 46. FIG. 8 shows the device with the locking pin 22 and arm 32 in the released or open position.

A second embodiment, of many possible embodiments, is shown in FIGS. 9 to 12, with its elements identified with reference numbers similar to those used in the first-described embodiment, but raised by 100.

Here, the overhead door locking mechanism 110 has a mounting block 112 at its distal end which attaches to the vertical rail or track (not shown here) of the associated overhead door. A flat front plate 114 extends distal to proximal. A sliding pin 122 is held in the frame of the mechanism and slides distally to lock and proximally to unlock, in similar fashion as in the first embodiment. As seen in the reverse-side views of FIGS. 10 and 12, there is a U-shaped box member 118 welded onto the plate 114, and one wall 119 of this has a round hole 126 therein to accommodate the pin. The plate 114 extends distally beyond this wall 119 and has a retaining slot 120 or cutout in it for engaging the radial arm 132 of the sliding pin 122. In this embodiment, the arm 132 is in the form of a flat steel plate that is affixed onto the proximal end of the pin 122. There is an opening 134 formed in the arm 132 to accommodate the shackle of a padlock. This opening is near to the axis of the pin, closer than the limits of the slot or cutout 120, so that the arm 132 cannot be rotated out of engagement when the padlock is in place. Also, as shown here there is a retaining pin 130 inserted into a transverse hole in the sliding pin 122 to retain the proximal end of the coil spring 128, and also to limit travel of the sliding pin 122 in the direction towards the transverse wall 119 and pin opening 126.

Figure 13:
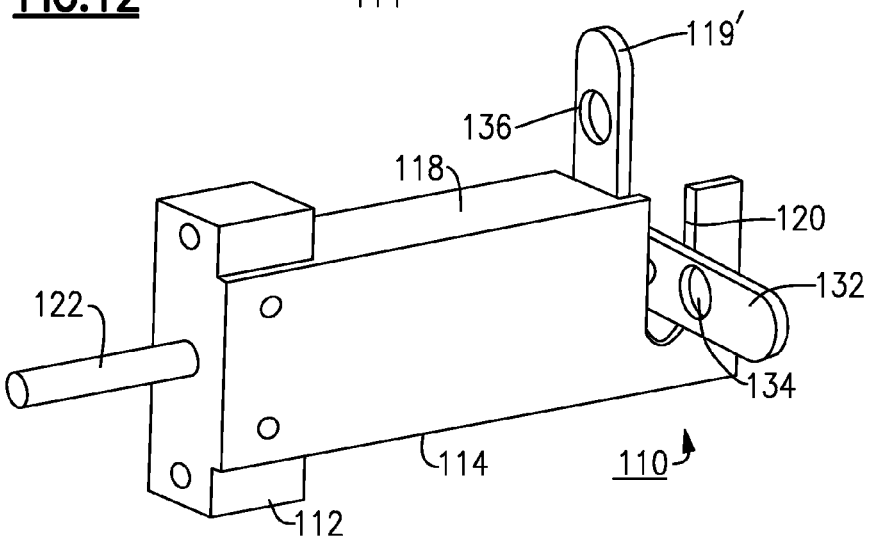
FIG. 13 is a perspective view of a variant thereof.

FIG. 13 illustrates a variant of the embodiment of FIGS. 9-12, in which like components are identified with similar reference numbers. Here the lock back wall 119' or back plate extends above the top of the box member 118, and is provided with a padlock opening 136.

The embodiments shown and described here illustrate the main principals of the invention, but many other applications and arrangements are possible. The shape and dimensions of the mounting blocks 14, 112, and the size and materials used for the sliding pin can be varied depending on engineering and design choices. Also, while a coil spring 28 or 128 is preferred here, other flexible, resilient spring arrangements could be employed. It should be understood and appreciated that while the invention has been described with reference to specific preferred embodiments, the invention is certainly not limited to those precise embodiments. Rather, many modifications and variations will become apparent to persons of skill in the art without departure from the scope and spirit of this invention.

We claim:

1. A locking mechanism that has a proximal end and a distal end that is adapted to attach to a flat outer web of a vertical track of an overhead door to hold the door locked when the door is in its lowered or closed position, the overhead door having a plurality of rollers that travel vertically within the vertical track, the locking mechanism comprising:

a frame, including a distal mounting portion at the distal end thereof that is adapted to be affixed onto the flat outer web of said vertical track, the frame extending proximally therefrom;

a sliding pin or dowel having an axis extending proximally-distally in said frame and that passes in an axial direction through an opening in the distal mounting portion of the frame and configured to penetrate the flat outer web portion of said vertical track so as to block travel of the rollers when the pin is extended distally into the track, with an arm affixed onto and extending radially from a proximal end of said sliding pin or dowel, the pin or dowel being free to rotate at least a limited amount;

the distal mounting portion of said frame having fastener openings therethrough extending axially and parallel to said sliding pin or dowel;

one or more fasteners passing through said fastener openings in said distal mounting portion and configured to engage said flat outer web of said vertical track to secure the distal mounting portion of the locking mechanism to said vertical track;

a spring contained within said frame and urging said sliding pin or dowel axially in said proximal direction and out of contact with said rollers; and retaining structure at a proximal end of said frame configured for engaging said radial arm when the sliding pin or dowel is slid distally to a locked position to hold said radial arm and said pin or dowel in the locked position, and the radial arm being configured for being rotated out of engagement therewith to permit the pin to slide proximally to an unlocked position, such that the locking mechanism is configured to be set into position to lock the overhead door by pushing said arm distally against the force of the spring and rotating the arm into engagement with said retaining structure, and is released from such position to unlock the overhead door by rotating said arm out of engagement with said retaining structure.

2. The lock mechanism of claim 1 wherein one or both of said radial arm and said retaining structure includes an opening adapted to accommodate a padlock, such that the padlock when in place in said opening prevents the radial arm from being rotated out of engagement with said retaining structure.

3. The lock mechanism of claim 1 wherein said frame includes a U-shaped box welded onto a front plate.

4. The lock mechanism of claim 1 wherein said spring includes a coil spring coaxially disposed over said sliding pin and having one end seated against said distal mounting portion and another end seated against a retaining member that is affixed onto said sliding pin.

5. The lock mechanism of claim 1 wherein said distal mounting portion includes a mounting block having a central aperture therein to serve as said opening for the sliding pin, and said fastener openings including first and second mounting openings disposed in said mounting block above and below the central aperture, respectively, and each adapted to receive a mounting screw therein to serve as said one or more fasteners.

6. The lock mechanism of claim 1 wherein said retaining structure includes a proximal block having a proximal pin opening therein aligned with the opening in the distal mounting portion.

7. The lock mechanism of claim 6 wherein said retaining structure includes a retaining plate offset proximally from said proximal block and adapted to block proximal motion of the radial arm of said sliding pin.

8. The lock mechanism of claim 7 wherein said retaining plate includes an aperture therethrough adapted to receive the shackle of a padlock such that when said padlock is in place the shackle thereof blocks rotation of said radial arm out of engagement with said retaining plate.

9. The lock mechanism of claim 1 wherein the radial arm of said sliding pin or dowel is in the form of a flat plate affixed onto a proximal end of said sliding pin or dowel.

* * * * *